US008104574B1

(12) United States Patent
Kellenaers

(10) Patent No.: US 8,104,574 B1
(45) Date of Patent: Jan. 31, 2012

(54) TEMPORARY NOISE CONTROL CURTAIN WALL SYSTEM

(76) Inventor: Steve Kellenaers, Forth Worth, TX (US)

( * ) Notice: Subject to any disclaimer, the term of this patent is extended or adjusted under 35 U.S.C. 154(b) by 0 days.

(21) Appl. No.: 12/854,063

(22) Filed: Aug. 10, 2010

Related U.S. Application Data

(60) Provisional application No. 61/318,286, filed on Mar. 27, 2010.

(51) Int. Cl.
*E04B 1/343* (2006.01)
*E06B 3/96* (2006.01)

(52) U.S. Cl. ..... 181/287; 160/184

(58) Field of Classification Search ..... 181/287, 181/210; 160/123, 124, 184, 330, 368.1
See application file for complete search history.

(56) References Cited

U.S. PATENT DOCUMENTS 916,832 A * 3/1909 Bittlinger ..... 160/374
4,193,474 A * 3/1980 Okubo et al. ..... 181/287
6,085,861 A * 7/2000 Jines ..... 181/30
6,446,751 B1 * 9/2002 Ahuja et al. ..... 181/295
7,562,743 B2 * 7/2009 Beeson et al. ..... 181/287
2007/0125019 A1 * 6/2007 Morgan ..... 52/235

OTHER PUBLICATIONS

Knauf Insulation; "Metal Building Insulation with ECOSE™ Technology" data sheet; Knauf Insulation GmbH, Shelbyville TN; 2009.
Certainteed; "Specification Sheet—Metal Building Insulation 202-96"; CertainTeed Corp.; 2004.
Safe 'N Secure USA; certification of 2" flat hook; Safe 'N Secure USA, Dallas TX; Nov. 17, 2009.
Data sheet: "Anefil Nylon Bonded Tex '210' (M13)"; Nov. 18, 2009.
Seattle Textile; "61" 18.5 oz "F/R" Vinyl Tex PVC Coated Polyester Specifications; Seattle Textile Co., Seattle WA.

* cited by examiner

*Primary Examiner* — Jeremy Luks
(74) *Attorney, Agent, or Firm* — Theodore F. Shiells; Shiells Law Firm P.C.

(57) ABSTRACT

A temporary sound barrier system is provided, with two support columns, a stiffening structure fixed between the support columns, and at least two sound proofing curtain elements having top and bottom edges attached to the two support columns and over the stiffening structure. The curtain elements preferably at least partially overlap, the overlapping portions of the curtain elements being sufficiently free to move with respect to one another to permit a substantial amount of wind to pass between them, to reduce wind loading and to minimize build up of noxious or flammable gases.

17 Claims, 6 Drawing Sheets

TEMPORARY NOISE CONTROL CURTAIN WALL SYSTEM

CROSS-REFERENCE TO RELATED APPLICATIONS

This application relates to, and claims the benefit of the filing date of, co-pending U.S. provisional patent application Ser. No. 61/318,286 entitled TEMPORARY NOISE CONTROL CURTAIN WALL SYSTEM, filed Mar. 27, 2010, the entire contents of which are incorporated herein by reference for all purposes.

FIELD OF THE INVENTION

This invention relates generally to sound barriers and, more particularly, to temporary noise control curtains.

BACKGROUND

In many industrial operations, including oil and gas exploration and production, large and noisy equipment is used. In many instances, it is necessary to protect personnel working in nearby areas, or nearby members of the public, from the noise generated from such equipment, for safety or other reasons.

Where the noise generating equipment is intended for substantially permanent installation, permanent noise blocking walls, such as cinder block walls, may be permanently installed. For other applications, however, the noise generating equipment may be installed on a more temporary basis, such as is common in oil and gas exploration applications. In such applications, it is desirable to employ a noise control wall which can be removed or moved when the need for noise control is no longer present at that location, but which is still very durable in a harsh industrial or outdoor environment.

In prior temporary noise control walls, a sound absorbing blanket may be used as the wall. However, a conventional sound absorbing blanket wall is relatively weak as compared to permanent noise blocking walls such as cinder block walls. Furthermore, in the outdoor environments that are common for many applications, including oil and gas exploration and production, there can be severe wind loads imposed on noise control walls. The force of a wind load on a wall is generally a function of the total area of the wall. Although permanent noise blocking walls such as cinder block walls can be readily designed to survive relatively high wind loads, a conventional sound absorbing blanket wall of the same size, in terms of total area, as a cinder block wall, though exposed to the same wind load, can be destroyed or damaged by high winds.

Furthermore, in oil and gas operations, where either a conventional sound absorbing blanket or permanent noise blocking wall is used, the blanket or wall tends to impede free flow of air through the interior space formed by the blanket or wall. Because it is common for noxious, poisonous or flammable gases to be released in oil and gas operations, the lack of free circulation of outside air though the interior space can pose a safety hazard.

Accordingly, it is an object of the present invention to provide a noise control wall that is effective for controlling noise, can be installed on a temporary basis, if desired, can be readily transported, is durable and less prone to damage in windy environments, and facilitates free flow of air through the interior space within the wall to minimize the buildup of noxious, poisonous or flammable gases.

SUMMARY OF THE INVENTION

These and other objects are accomplished in accordance with an embodiment of a sound barrier system in accordance with an embodiment of the present invention. In one aspect, the barrier system can have two or more support columns, a stiffening structure fixed between the support columns, and at least two sound attenuating curtain elements coupled to the two or more support columns, an upper one of said curtain elements being disposed above a lower one of said curtain elements, said upper one of said curtain elements having a lower portion that at least partially overlaps an upper portion of said lower one of said curtain elements, said lower portion of said upper one of said curtain elements generally overlying said upper portion of said lower one of said curtain elements when in a normal and undisturbed condition, but being free to move away from said upper portion of said lower one of said curtain elements when a wind load is imposed thereon sufficiently to permit a substantial amount of incident wind to pass between said lower portion of said upper one of said curtain elements and said upper portion of said lower one of said curtain elements to substantially reduce total wind load on the sound barrier system.

BRIEF DESCRIPTION OF THE DRAWINGS

A more complete understanding of the invention may be had by reference to the following Detailed Description when taken in conjunction with the accompanying drawings, in which.

DETAILED DESCRIPTION

In the following discussion, numerous specific details are set forth to provide a thorough understanding of the present invention. However, it will be understood by those skilled in the art that the present invention can be practiced by those skilled in the art following review of this description, without such specific details. In the interest of conciseness, various components well-known to the art have not been shown or discussed in detail.

Figure 1:
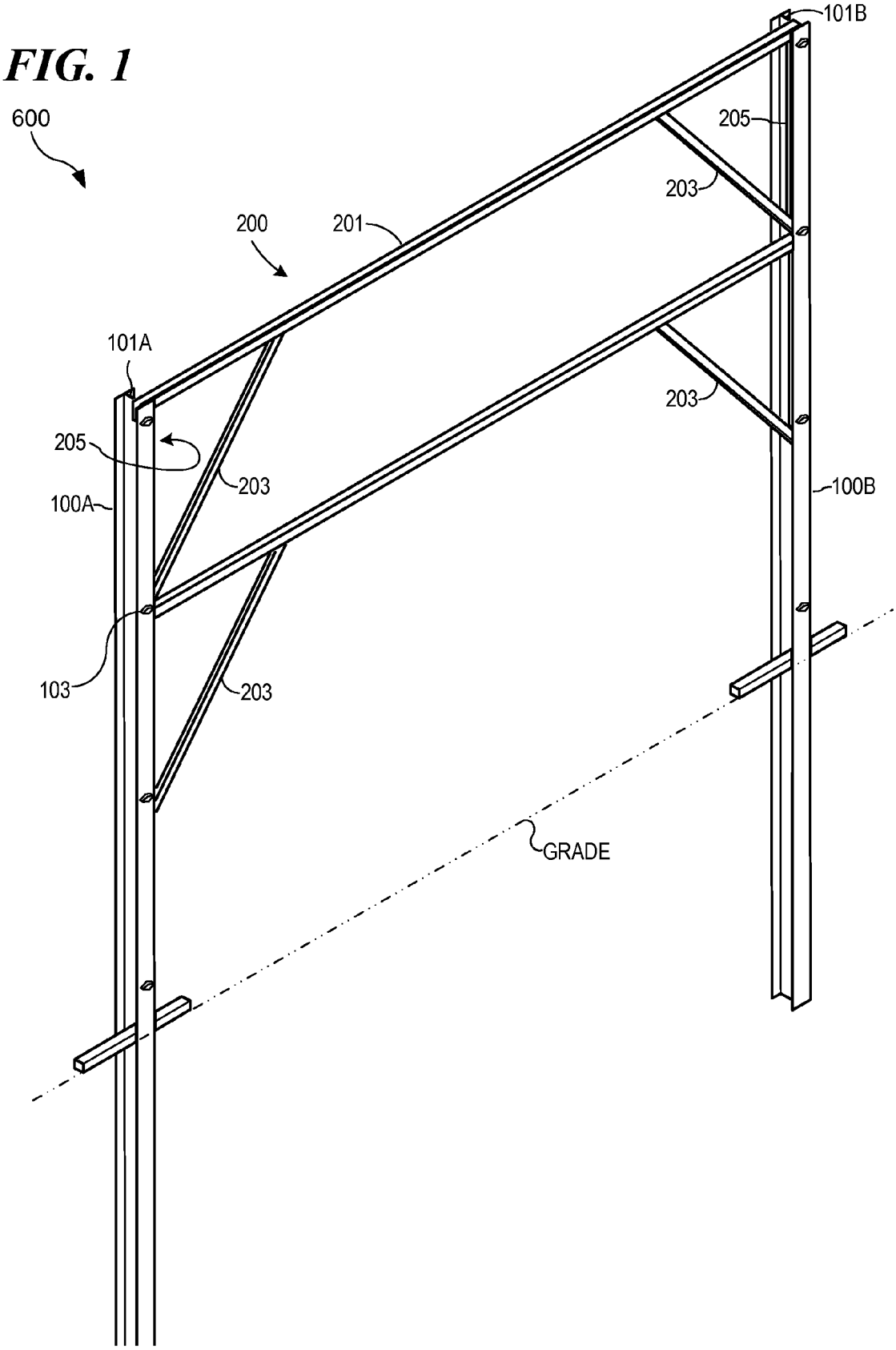
FIG. 1 is a perspective view of one embodiment of a sound barrier structure.

Turning to FIG. 1, a sound barrier structure 600 in accordance with an embodiment of the present invention has at least two support columns 100A, 100B and a stiffening structure 200 placed into the ground. In one embodiment, the spacing of the support columns 100A, 100B can be on 20'1" centers, but spacing can vary widely. The support columns can be I-beam columns, round columns or other configurations, with the size of the columns being generally related to the expected wind load and desired wall height. As depicted in FIG. 1, the lower ends of the support columns 100A, 100B can be buried and/or installed on concrete piers, or the like for a secure placement, while still being removable if and when it is desired to remove them. Optionally, a square tube 202 can be inserted through or otherwise attached to the lower end of the columns near the grade level to help maintain the columns in position with respect to the ground once they are in place.

Figure 2:
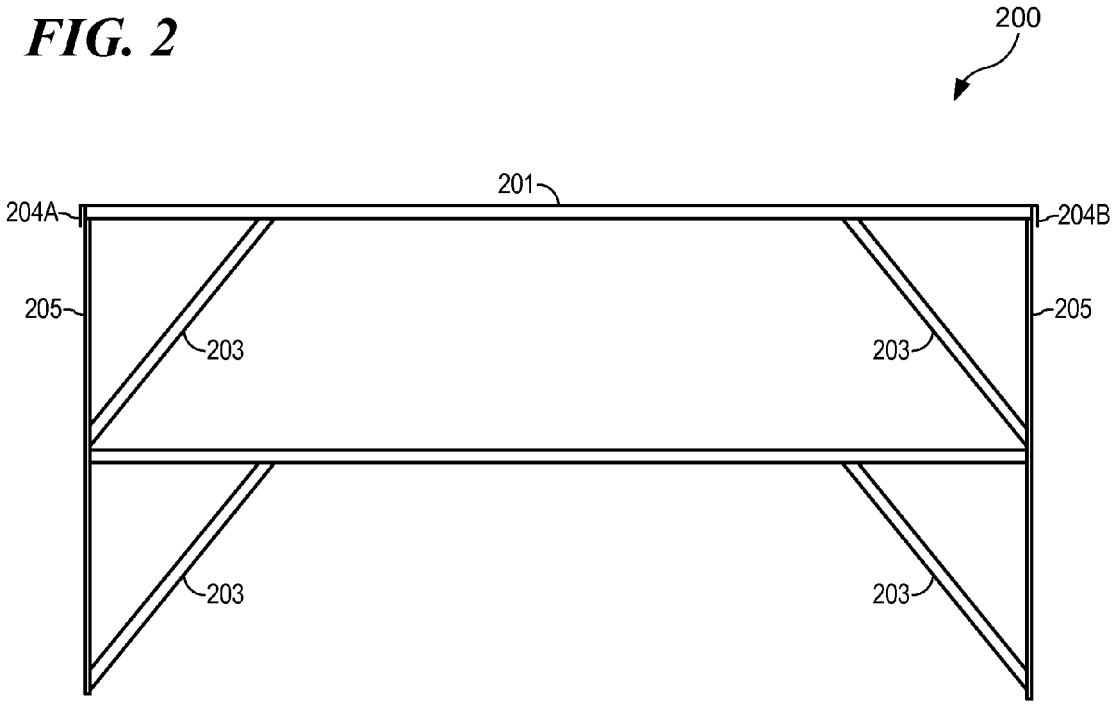
FIG. 2 is a perspective view of one embodiment of a stiffening structure.

A stiffening structure 200 can be disposed between the support columns 100A, 100B to provide lateral support between them. As depicted in FIGS. 1 and 2, one embodiment of a stiffening structure 200 can have one or more transverse beams 201 extending between the two columns 100A, 100B, and can have two vertical beams 205 extending down from opposing ends of the transverse beam 201, in between the webs of the support columns 100A, 100B. In the exemplary embodiment depicted, two transverse beams 201 are used. Diagonal braces 203 can connect the transverse beams 201 to each of the vertical beams 205 at each corner. In this way, the stiffening structure 200 can be a relatively rigid frame-like structure that can fit between the support columns 100A, 100B near the top of columns 101A and 101B, thereby providing lateral support for the support columns 100A, 100B.

Figure 3:
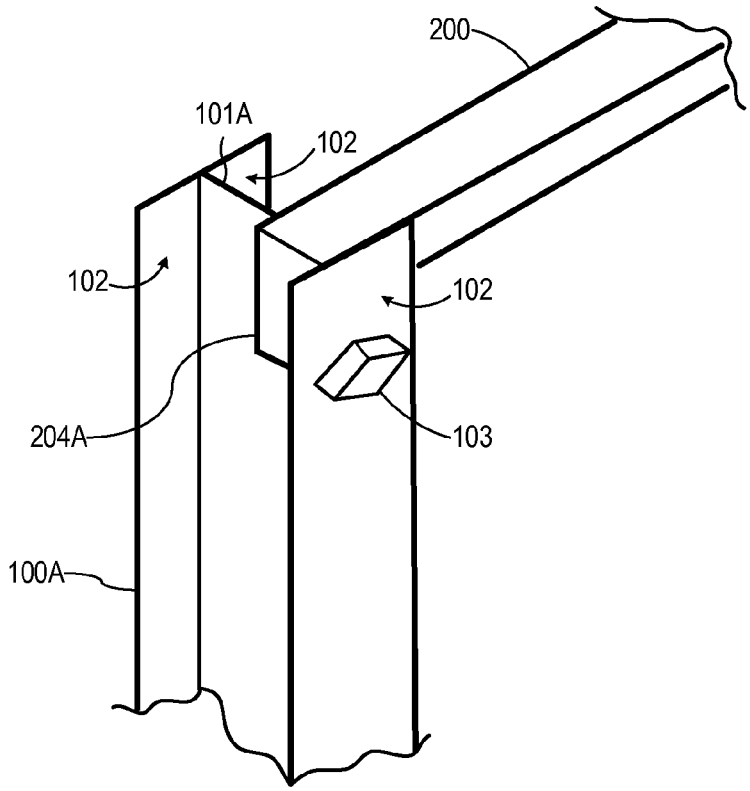
FIG. 3 is a perspective view of a stiffening structure attached to a support column.

Stiffening structure 200 can be supported by the columns 100A, 100B by means of securement hooks 204A, 204B mounted at each end of the top transverse beam 201 of stiffening structure 200. As shown in FIG. 3, an I-beam column is used as support column 100A and securement hook 204A can hang at the top of the central web of the I-Beam 101A. The securement hooks 204A, 204B thus vertically hold the stiffening structure 200 at the top of the columns 100A, 100B, by means of the central web of the I-beam, which serves as a support for the securement hooks 204A, 204B. FIG. 3 shows one embodiment where the stiffening structure 200 can be attached to the support column 100A. The stiffening structure 200 can be slid between the retaining structures 102 of the column 100A, with the securement hook 204A supported on the securement hook support 101A. The retaining structures 102 also limit the horizontal movement of the stiffening structure 200. In one embodiment in which I-beams are used as the supporting columns, the retaining structures 102 are the flanges of the I-beam and the stiffening structure 200 is contained within the channel created by the flanges, the flanges limiting the horizontal movement of the stiffening structure 200. However, while an I-beam is advantageous, any column having a general C-shape, U-shape, round, any other shape may be used as a support column and the stiffening structure 200 can be attached to the columns 100A, 100B by any convenient means.

Figure 4:
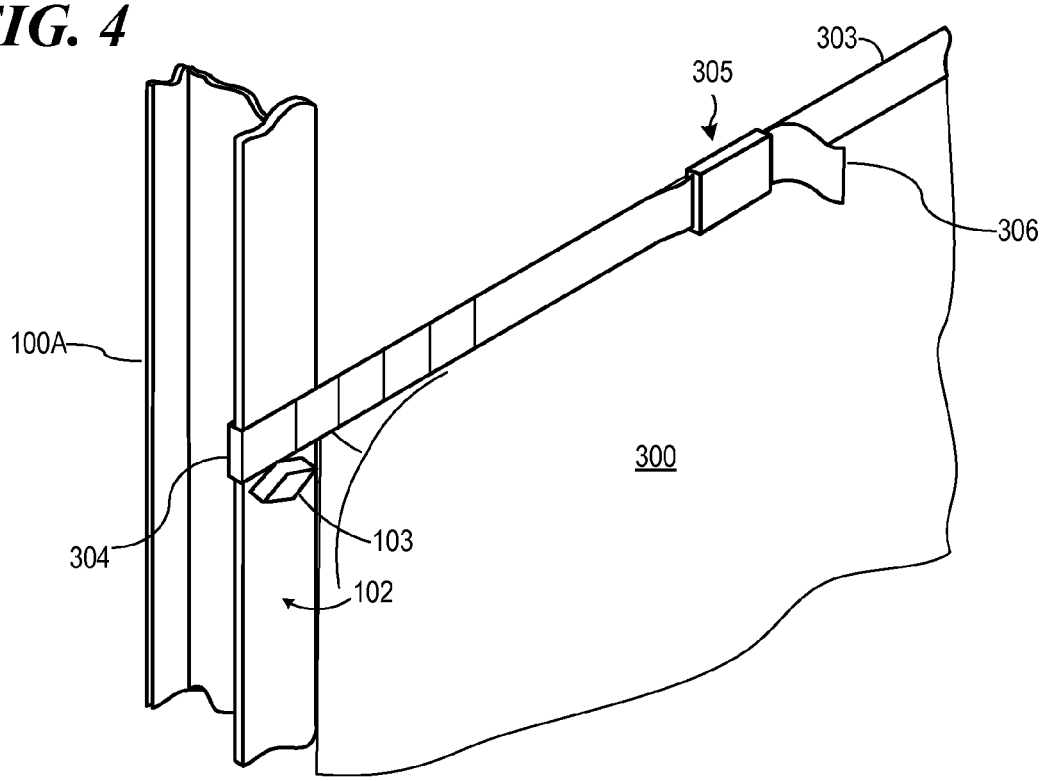
FIG. 4 is a perspective view of the left side of a ratchet strap system coupling the curtain element to the support column.
Figure 5:
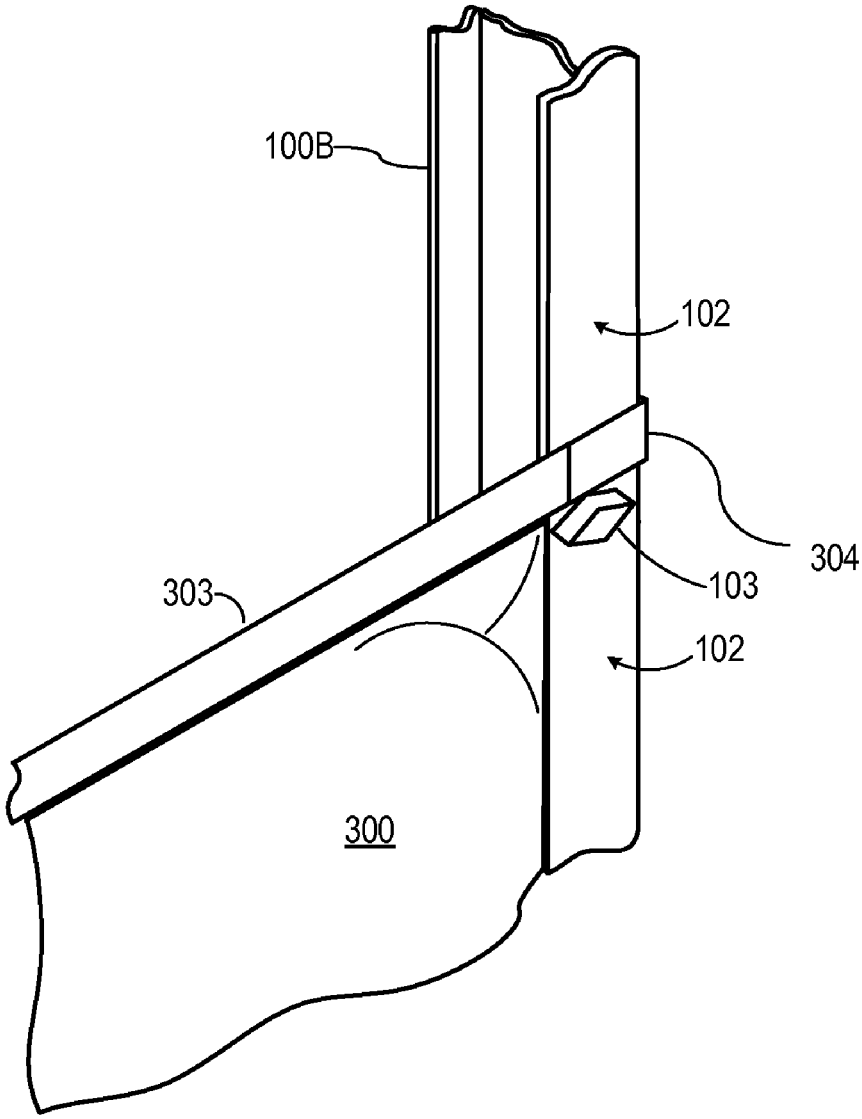
FIG. 5 is a perspective view of the right side of a ratchet strap system coupling the curtain element to the support column.

FIGS. 4-5 depict one embodiment in which the curtain element is coupled to the support columns 100A, 100B using a ratchet system near a top longitudinal edge of the curtain element. Each of the curtain elements 300 typically has a ratchet strap 303 sewn, stapled, riveted, or the like, near the top or bottom or both longitudinal edges of the curtain. The length of the ratchet strap, at least at for a ratchet strap 303 near the top, is typically greater than the length of the longitudinal edge of the curtain. The ratchet strap 303 can have a right and left end protruding past the transverse curtain edges. As seen in FIG. 4, the left side of the ratchet system comprises a ratchet hook 304 attached to the left end of the ratchet strap 306 or directly to the ratchet 305 itself. The left side of the ratchet system is configured to attach the curtain element to the first support column retaining structure 102 near the top longitudinal edge of the curtain element. FIG. 5 depicts the right side of the ratchet system and comprises a ratchet hook 304 attached to the right edge of the ratchet strap 303, the ratchet hook configured to attach to the support column 100B. Sufficient tension to attach and suspend the curtain 300 and hold the stiffening structure/curtain/column assembly together is created by shortening the ratchet strap distance between the at least two columns.

Figure 6:
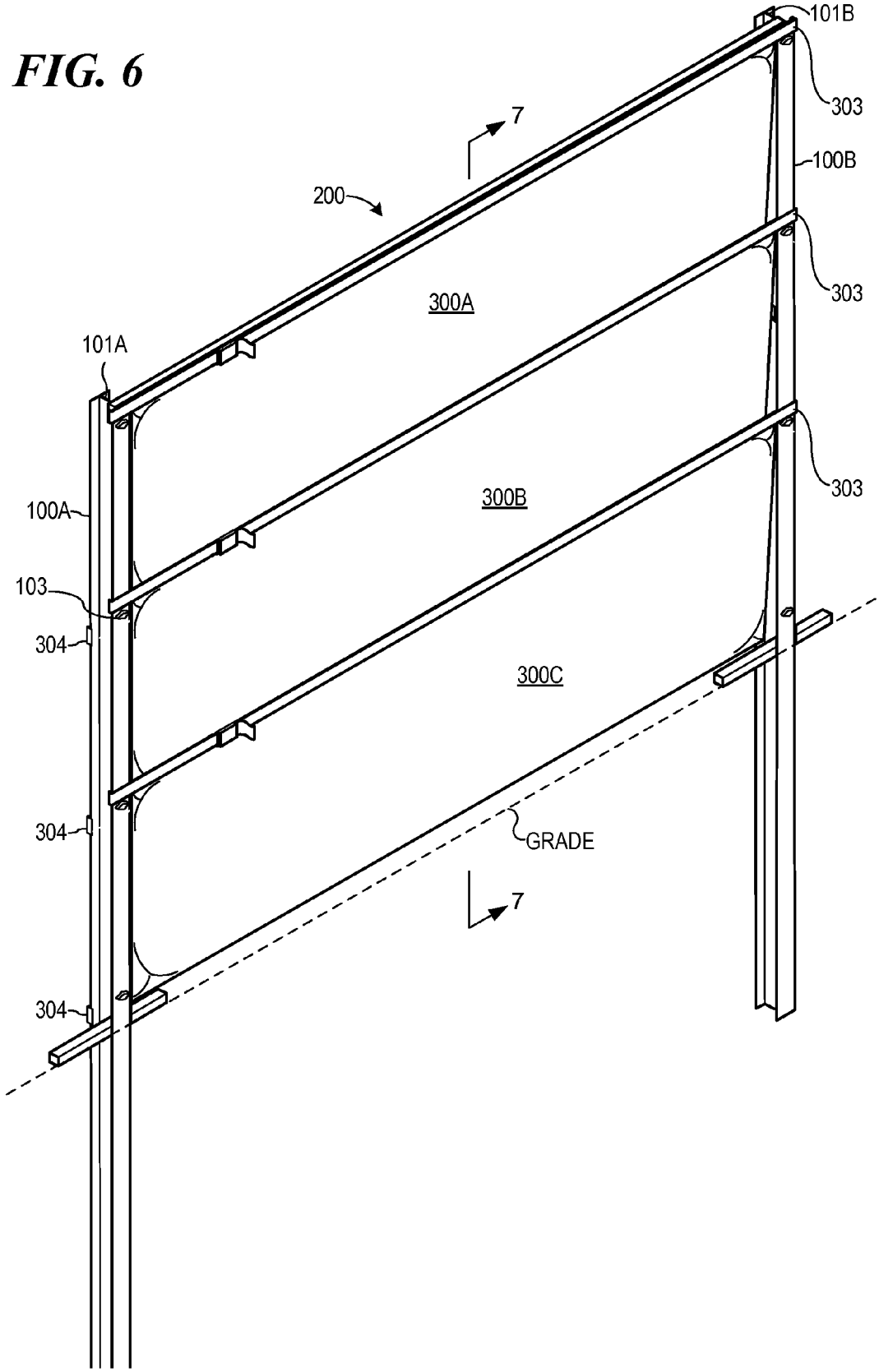
FIG. 6 is a perspective view of one embodiment of the sound barrier system comprising multiple curtain elements coupled to the support columns using ratchet systems and arranged in a "louvered" style.
Figure 7:
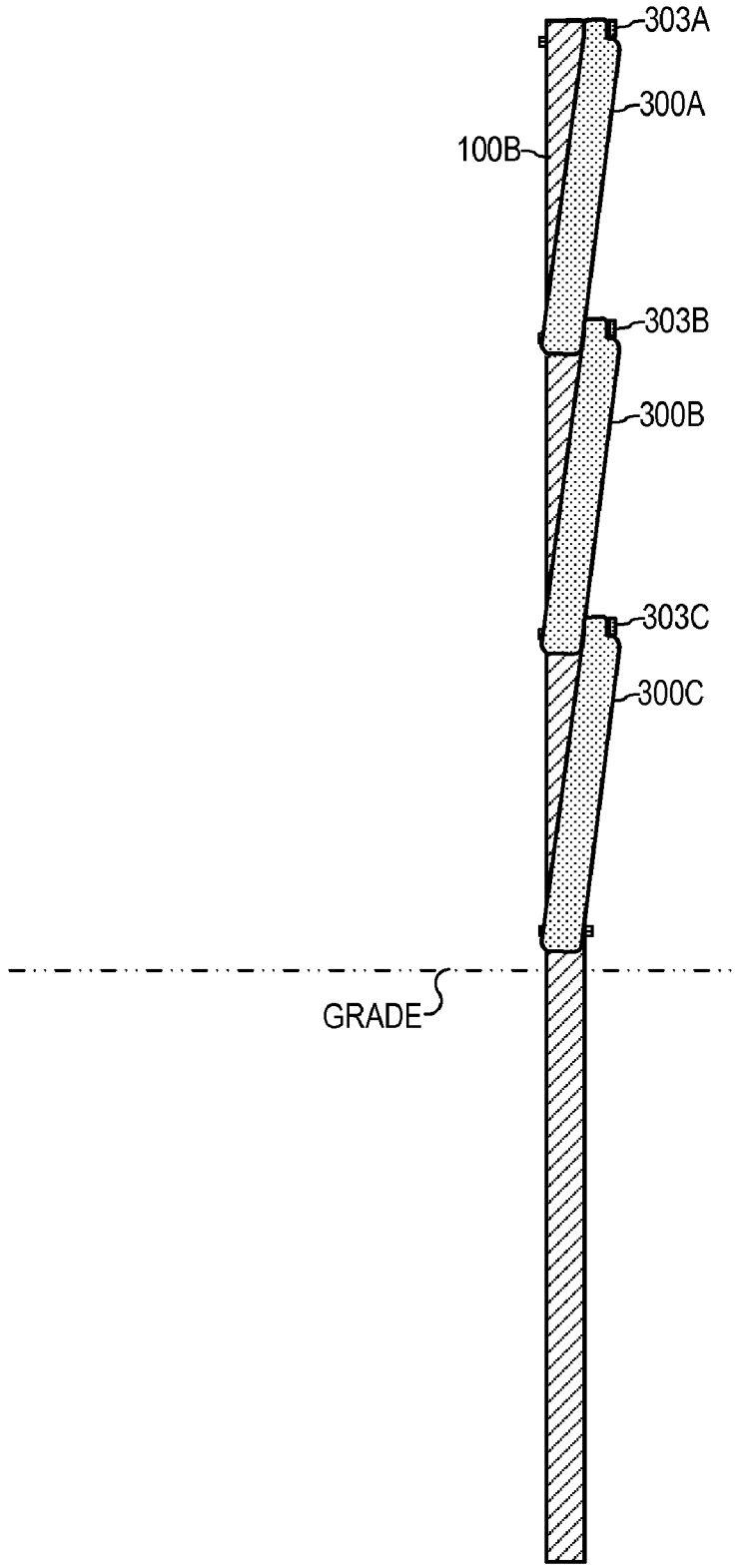

The support column 100A can have horizontal protrusions 103. Horizontal protrusions 103 can be welded, but may also be attached in a variety of ways to the retaining structures 102 at spaced intervals. In one embodiment, a spacing of five feet is used, but many other spacings can be employed. As seen in FIGS. 4 and 5, the ratchet hooks 304 can be attached to the retaining surfaces 102 directly above a horizontal protrusion 103 on the support columns 100A, 100B. The ratchet hooks can also be attached below the horizontal protrusion 103 (not shown). The horizontal protrusions 103 can prevent the curtain elements 300 from sliding down the support columns 100A, 100B. Looking to FIG. 6, the vertical spacing of the protrusions 103 is generally somewhat less than the width of one of the curtain elements 300, so that the lower portion of an upper one of the curtain elements 300 will at least partially overlap the upper portion of the adjacent lower one of the curtain elements 300. Thus, the multiple overlapped curtain elements 300 will tend to have a "louvered" appearance, as seen in FIG. 6. It should be noted that although only three curtain elements 300 are depicted in FIG. 6, any number of curtain elements greater than two may be employed, depending upon the total height of the sound attenuating wall required.

As shown in FIG. 6, the sound barrier assembly has at least two curtains 300, but preferably has a plurality, which can be secured to the support columns 100A, 100B and across the stiffening structure 200. The curtains 300 can be approximately rectangular shaped, but can also be other shapes, including trapezoidal. Dimensions of approximately 5'×20' have been found useful in practice, although many other dimensions and proportions can be employed, depending upon the expected wind loads and support column 100A, 100B spacing.

The two outer surfaces of each curtain can comprise a waterproof and flame resistant material. An example of a suitable and durable material is 18.5 oz VINYL TEX Vinyl Coated Fabric. The surfaces can be joined together about the edges to form a waterproof pocket in which the insulation material is disposed within. The sound insulation material inside the outer surfaces can be any suitable durable sound attenuation material. An example of a suitable and durable material is Knauf Metal Building Insulation with ECOSE™ Technology, but can comprise any noncombustible, sound reducing material. A suitable thickness of the insulation is 3¼", although this can vary depending upon sound attenuation requirements.

As seen in FIG. 6, the curtain elements 300 can be attached to retaining surfaces 102 having different vertical planes, creating an "angled-up" or "louvered" placement of the curtain elements 300 in relation to the support columns 100A, 100B, with some overlapping of portions of the curtain elements 300. That is, the upper one of the curtain elements 300 has a lower portion that at least partially overlaps an upper portion of the adjacent and lower one of the curtain elements. However, the lower portion of the upper one of said curtain elements is free to move away from said upper portion of the lower one of said curtain elements when a wind load is imposed thereon sufficiently to permit a substantial amount of incident wind to pass between the lower portion of the upper one of the curtain elements and the upper portion of the lower one of the curtain elements. This substantially reduces total wind load on the sound barrier system. The reduction of expected wind loading on the system increases durability and can reduce the amount of structural bracing of the system required. This reduction in wind loading can also increase the safety of the system and cost effectiveness. However, because the curtain elements 300 are still generally overlapping, even when some wind passes between the curtain elements, the sound that is intended to be blocked and attenuated by the wall will still tend to be blocked and attenuated, and also deflected up and away from the ground, generally in the "angled-up" direction of the space formed between the overlapped curtain elements.

It is understood that the present invention can take many forms and embodiments. Accordingly, several variations may be made in the foregoing without departing from the spirit or the scope of the invention. For example, the attachment method depicted in FIGS. 3 and 4, in lieu of the two ratchet straps, ratchet systems, horizontal protrusions and ratchet hooks, four connectors such as snap hooks attached to eyebolts mounted to the columns, and the like, may be used to couple the top and bottom longitudinal edges of the curtain elements to the support columns. The ratchet systems and horizontal protrusions, however, are advantageous because this design avoids creating holes in the columns, which could structurally weaken or affect the integrity of the columns.

In another example of variations in the foregoing, the attachment method depicted in FIG. 3 may vary from the securement hook 204A resting on the securement hook support 101A to any suitable means of vertically securing the stiffening structure 200. This depicted method is advantageous because it does not physically alter the column and does not change the structural integrity of the column.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention can be employed without a corresponding use of the other features. Many such variations and modifications can be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A sound barrier assembly, comprising:

at least two support columns, a first support column and a second support column;

at least two sound attenuating curtain elements, an upper one of said curtain elements being disposed above a lower one of said curtain elements, said upper one of said curtain elements having a lower portion that at least partially overlaps an upper portion of said lower one of said curtain elements, said lower portion of said upper one of said curtain elements generally overlying said upper portion of said lower one of said curtain elements when in a normal and undisturbed condition, but being free to move away from said upper portion of said lower one of said curtain elements when a wind load is imposed thereon sufficiently to permit a substantial amount of incidental wind to pass between said lower portion of said upper one of said curtain elements and said upper portion of said lower one of said curtain elements to substantially reduce total wind load on the sound barrier system; and a stiffening structure disposed between the first support column and the second support column, the stiffening structure comprising:

at least one transverse beam configured to extend between the first support column and the second support column, the at least one transverse beam having a right end and a left end;

at least two vertical beams, a first vertical beam extending downward from the right end of the at least one transverse beam and a second vertical beam extending from the left end of the at least one transverse beam;

wherein the stiffening structure provides lateral support to the sound barrier assembly system;

wherein each of the support columns comprises two or more retaining structures, wherein at least a portion of the stiffening structure can be disposed between the two or more retaining structures, the two or more retaining structures limiting the horizontal movement of the stiffening structure relative to each of the support columns;

wherein each of the curtains elements is removably coupled to the at least two support columns using at least one ratchet system, the at least one ratchet system is joined to each of the at least two curtain elements near a longitudinal edge of the curtain element, the ratchet system joined to each of the first support column and second support column;

wherein the at least two sound attenuating curtain elements are detachably coupled to the at least two support columns.

2. The sound barrier assembly recited in claim 1, wherein the stiffening structure further comprises at least two diagonal braces, a first diagonal brace extending from the at least one transverse beam to the first vertical beam and a second diagonal brace extending from the at least on transverse beam to the second vertical beam.

3. The sound barrier assembly recited in claim 1, wherein the stiffening structure has at least two securement hooks, wherein each of the least two securement hooks is supported by one of the at least two support columns.

4. The sound barrier assembly recited in claim 1, wherein each of the first support column and the second support column has one or more support surfaces at an upper portion thereof, the support surfaces being configured to support the stiffening structure.

5. The sound barrier assembly recited in claim 1, wherein said curtain elements comprise:

a first flexible outer surface;

a second flexible sheet outer surface;

each of the first outer surface and the second outer surface has a periphery edge, the periphery edges being joined together;

the first outer surface and the second outer surface forming a generally flat curtain; and at least one layer of flexible insulation material disposed between the first outer surface and the second outer surface.

6. The sound barrier assembly recited in claim 5 wherein the insulation material comprises a noncombustible material or sound reducing material or both.

7. The sound barrier assembly recited in claim 5, wherein the outer surfaces comprise a flame resistant material or water proof material or both.

8. The sound barrier assembly recited in claim 4, wherein at least one support columns is an I-beam and the support surface in the internal web of the I-beam.

9. The sound barrier assembly recited in claim 1, wherein a cross-section of at least a portion of each of the support columns is generally U-shaped, C-shaped, I-shaped, or concave.

10. The sound barrier assembly recited in claim 1, wherein each of the support columns comprises two retaining structures, each of the retaining structures extend at least partially along opposing vertical edges of each of the support columns creating a retaining channel, the retaining channel located between the retaining structures and at least partially receives at least one of the vertical beams.

11. The sound barrier assembly recited in claim 1, wherein each of the curtain elements comprises of a first edge and opposing edge, wherein the first edge is removably coupled to the first support column and the second edge is removably coupled to the second support column.

12. The sound barrier assembly recited in claim 1, wherein each of the at least two support columns comprises a plurality of horizontal protrusions attached to the two or more retaining structures, the horizontal protrusions configured to limit vertical movement of each of the ratchet systems in relation to the support columns.

13. The sound barrier assembly recited in claim 12, wherein the horizontal protrusions are attached to at least one of the retaining structures with a vertical spacing not greater than the vertical height of each of the at least two curtain elements.

14. The sound barrier assembly recited in claim 1 wherein each of the curtain elements is substantially rectangular shaped.

15. The sound barrier assembly recited in claim 14, wherein each of the curtain elements comprises a top longitudinal edge and a bottom longitudinal edge, wherein at least two connectors are located near the top longitudinal edge of each of the curtain elements and wherein the connectors are configured to attach the top longitudinal edge to the first support column and the second supporting column.

16. The sound barrier assembly recited in claim 15, wherein the top longitudinal edge is disposed on a retaining structure in a first vertical plane and the bottom longitudinal edge is disposed on a retaining structure in a second vertical plane, the first vertical plane different from the second vertical plane, thereby creating an angled placement of the at least two curtain elements relative to longitudinal axes of each of the support columns.

17. The sound barrier assembly recited in claim 11, wherein each of the curtain elements comprises:

a top longitudinal edge;

a first ratchet strap having a right end and a left end, the ratchet strap being joined at least partially along the top longitudinal edge;

a first ratchet hook coupled to the right end of the first ratchet strap configured to attach to the first support column;

a second ratchet hook coupled to the left end of the first ratchet strap configured to attach to the second support column;

a first ratchet system attached to the ratchet strap and configured to provide tension in the ratchet strap;

and wherein a sufficient amount of tension is created in the ratchet strap by the ratchet system to couple the curtain element to the first support column and the second support column.

* * * * *